US005563564A

United States Patent [19]

Chu et al.

[11] Patent Number: 5,563,564

[45] Date of Patent: Oct. 8, 1996

[54] STRONG HIGH-TEMPERATURE SUPERCONDUCTOR TRAPPED FIELD MAGNETS

[75] Inventors: Ching-Wu Chu; Yuyi Xue; Li Gao; Ruling Meng, all of Houston; Diego A. Ramirez, Pasadena, all of Tex.

[73] Assignee: University of Houston, Houston, Tex.

[21] Appl. No.: 52,360

[22] Filed: Apr. 22, 1993

[51] Int. Cl.[6] ..... H01F 1/00; H01B 12/00

[52] U.S. Cl. ..... 335/216; 505/212

[58] Field of Search ..... 335/216, 302, 335/306; 336/DIG. 1; 310/90.5; 505/211, 212

[56] References Cited

U.S. PATENT DOCUMENTS

| | | | |
|---|---|---|---|
| 3,141,967 | 7/1964 | Meiklejohn . | |
| 3,325,758 | 6/1967 | Cook | 335/217 |
| 4,471,180 | 9/1984 | Schwartz | 200/67 |
| 5,030,617 | 7/1991 | Legge . | |

FOREIGN PATENT DOCUMENTS 1-182949 7/1989 Japan .

OTHER PUBLICATIONS

Texas Center for Superconductivity at the Univ. of Houston, "Improvement of Persistent Magnetic Field Trapping in Bulk Y–Ba–Cu–O Superconductors", I.G. Chen, R. Weinstein, Submitted to the Proceedings of the 1992 Applied Superconductivity Conference, Chicago, IL, Aug. 23–28, Preprint No. 92:122.

"Peristent magnetic fields trapped in high Tc superconductor", R. Weinstein, In–Gann Chen, J. Liu, D. Parks, Appl. Phys. Lett. 56 (15), 9 Apr. 1990.

"Dependence of maximum trappable field on superconducting Nb3Sn cylinder wall thickness", Mario Rabinowitz, Applied Physics Letters, vol. 30, No. 11, 1 Jun. 1977.

"Conductor Design with High–Tc Ceramics: A Review", E.W. Collings, Battelle Memorial Institute, Advanced Materials Group, Columbus, OH, (date unavailable).

"Magnetization of Hard Superconductor", C.P. Bean, Physical Review Letters, vol. 8, No. 6, Mar. 15, 1962.

"An Investigation of the Very Incomplete Meissner Effect", M. Rabinowitx, E.L. Garwin, D.J. Frankel, Lettere Al Nuoveo Cimento, vol. 7, No. 1, 1973.

M. Rabinowitz et al., "An Investigation of the Very Incomplete Meissner Effect", *Lettere Al Nuovo Cimento*, vol. 7, No. 1, pp. 1–4.

R. Weinstein et al., "Persistent Magnetic Fielas Trapped in High $T_c$ Superconductor," *Appl. Phys. Lett.* 56 (15), Apr. 9, 1990, pp. 1475–1477.

C.P. Bean, "Magnetization of Hard Superconductors," *Physical Review Letters,* vol. 8, No. 6, Mar. 15, 1962, pp. 250–253.

I.G. Chen, "Improvement of Persistent Magnetic Field Trapping in Bulk Y–Ba–Cu–O Superconductors," Submitted to the Proceedings of the 1992 Applied Superconductivity Conference, Chicago, IL, Aug. 23–28, to be published in IEEE Transaction on Applied Superconductivity.

E.W. Collings, "Conductor Design with High–$T_c$ Ceramics: A Review," Battelle Memorial Institute, Advanced Materials Group, 505 King Ave., Columbus, OH 43201–2693, pp. 327–333.

(List continued on next page.)

*Primary Examiner*—Leo P. Picard
*Assistant Examiner*—Stephen T. Ryan
*Attorney, Agent, or Firm*—Fulbright & Jaworski L.L.P.

[57] ABSTRACT

A trapped field magnet formed of a high temperature type II superconductor material is disclosed. The trapped field magnet is formed of a plurality of relatively small, single-grain superconductive elements. Optimal shaped of these elements is in a regular truncated cone wherein the half cone angle is 55°, and the optimal orientation of each single-grain superconducting elements is an angle of $\phi_m$ with respect to the axis perpendicular to the upper and lower surface of the element, wherein the $\phi_m$=3 sinθcosθ/(3 cos$^2$θ0–1) and θ determines the location of the element (FIG. 3*a*).

8 Claims, 16 Drawing Sheets

OTHER PUBLICATIONS

M. Rabinowitz et al., "Dependence of Maximum Trappable Field on Superconducting $Nb_3Sn$ Cylinder Wall Thickness," *Applied Physics Letters*, vol. 30, No. 11, Jun. 1, 1977, pp. 607–609.

K. Sawano, et al., "High Magnetic Flux trapping by Melt–Grown YBaCuO Superconductors," *R&D Laboratories–I, Nippon Steel Corp., 1618 Ida, Nakahara–ku, Kawasaki 211* (Received Mar. 28, 1991; accepted for publication May 25, 1991), pp. 1157–1159.

STRONG HIGH-TEMPERATURE SUPERCONDUCTOR TRAPPED FIELD MAGNETS

BACKGROUND OF THE INVENTION

1. Field of the Invention

The invention relates to trapped field magnets formed from high temperature superconductor material. The present invention provides enhanced field strength superconductor magnets. Applications for this basic technology include motors, generators, magnetic clamps, rivet guns, magnetic resonance imaging, magnetic levitation bearings and other applications where enhanced field strength superconductor magnets are useful.

2. Description of the Prior Art

It has long been known that Type II superconductors could be used to replicate externally generated magnetic fields. M. Rabinowitz, et al., Nuovo Cimento Lett., 7, 1 (1973) disclosed low temperature magnetic replicas in 1973. Prior art magnetic replication efforts focused on achieving the fidelity of relatively small fields only at 4.2 K. Rabinowitz was the first to successfully trap a multipole field with high fidelity perpendicular to the axis of a cylinder made of low temperature superconductor such as Pb, Nb or $Nb_3Sn$. Rabinowitz also proposed to use a superconductor of simple geometry, i.e. a cylinder or a plate, as a magnetic replica to copy from a template a magnetic field with various complexity.

High temperature superconductors (HTS) were also known to be Type II and capable of trapping magnetic fields. Soon after the discovery of HTS, Weinstein proposed to use them to trap and replicate magnetic fields with additional advantages. See R. Weinstein, et al., Applied Physics Letter, 56, 1475 (1990). Notwithstanding these prior developments, practical applications for HTS trapped field magnets have been limited in several respects. One significant limitation of the prior art is the maximum strength of the trapped field which can be achieved using conventional methods.

HTS have a very high irreversible field $B_i$ which sets the theoretical limit for the maximum field strength $B_T$ achievable. For $YBa_2Cu_3O_{7-\delta}$ (YBCO), $B_i$ is approximately 4 T at 77° K. and >100 T at 4.2° K. when the field is parallel to the c-axis of this compound. It has been expected that $B_i$ could be further raised by high-energy heavy-particle irradiation. According to C. P. Bean, Physics Review Letter 8, 250 (1962), the maximum field strength $B_T$ is proportional to $J_c d$ for an infinite slab of superconductor with a thickness d and critical current density $J_c$, neglecting the magnetic field effect on $J_c$. Therefore one needs to enhance $J_c$ and/or d to achieve a large $B_T$.

Because of the short coherence length of HTS, only irradiation by high-energy particles has been found to be effective in raising the $J_c$ of bulk HTS to date. Researchers I. G. Chen and R. Weinstein, as reported in IEEE Transactions in Applied Superconductivity (1992), have found a four to six-fold enhancement of $B_T$ in bulk YBCO following high-energy proton-irradiation. Irradiation, however, is impractical because it is expensive and leaves the HTS radioactive.

Alternatively, one can increase $J_c$ by lowering the temperature for field trapping. Since $J_c$ is known to increase by a factor of 50 to 100 when cooled from 77 K. to 4.2 K., a very strong $B_T$ would be expected with $B_i$ as the only limit. Unfortunately, a flux-avalanche (FA) or large flux jump associated with thermal instabilities (See E. W. Collins, "Advances in Superconductivity II" (Springer-Verlag, Berlin, 1990; p. 327)) in bulk HTS was recently observed by us. This FA severely restricts the final $B_T$ to approximately 4–5 T at 4.2° K. in an unradiated YBCO bulk sample of dimensions approximately 20 mm diameter by 7 mm thick.

Because of the severely weakened $J_c$ at the grain boundaries in HTS due to their short coherence length, d represents the grain size instead of the sample size of an HTS used for a trapped field magnet. To increase $B_T$ by increasing d, one must grow bulk HTS with large grains. Recently we have succeeded in growing large, single-grain HTS (~40 mm diameter×15 mm thick). In larger HTS, however, the quality of the grain degrades with increasing d.

Until recently, the record $B_T$ was approximately 2.2 T at 4.2° K. in a cylinder wound with $NB_3Sn$ tapes kept at 4.2° K. M. W. Rabinowitz and S. D. Dahlgren, Applied Physics Letter 30, 607 (1977). Chen and Weinstein obtained a $B_T$ of approximately 1.42 T at 77° K. at the center of a stack of small YBCO tiles corresponding to a $B_T$ of only 0.7/T at the surface of the stack of YBCO tiles after proton-irradiation, or a much smaller value than 0.7/T prior to proton-irradiation. Sawano, et al., *Japan Journal of Applied Physics*, 30, L1157 (1991), succeeded in trapping a $B_T$ of approximately 0.72 T at 77° K. in a single grain YBCO disk (44 mm diameter×15 mm thick) before irradiation.

Within the inherent limit of $B_T<B_i$, the most serious obstacle to ultra-high $B_T$ at low temperatures (e.g., ≧4.2° K.) is FA due to thermal instabilities which increase with the dimensions of the HTS samples. The other obstacle is the degradation of the effective $J_c$ as the size of the bulk HTS increases. For instance, the $J_c$ at 77° K. for a small HTS sample (10×0.6×0.6 $mm^3$) is approximately $80\times10^3$ $A/cm^2$ in contrast to the approximate $6\times10^3$ $A/cm^2$ for a large one (45 mm diameter×15 mm thick). This limitation is attributed to the present difficulties in large-grain growth, e.g. controlling the exact crystal alignment and minimizing the weak links in large samples.

SUMMARY OF THE INVENTION

In contrast to prior efforts to achieve enhanced $B_T$, the method and apparatus of the present invention achieve high $B_T$ by using stacks of small, single-grain HTS bricks without irradiation, the overall dimensions of each of which are below the critical size for flux avalanche (FA). The critical size decreases with decreasing operating temperature. Furthermore, the $B_T$ of an HTS trapped field magnet so constructed can be further improved by assembling the individual HTS bricks in the truncated cone pattern disclosed herein. The $B_T$ can be doubled when two such trapped-field magnets with a common field orientation are aligned on a common central axis on opposite sides of the target area. Still further enhancement is achieved by properly orienting the grain direction of the HTS bricks. Another unique aspect of the present invention is that by designing the trapped-field magnet to control the flux avalanche (FA) effect one can then control the onset of FA to provide a practical way to quickly quench the trapped field. A controlled FA facilitates numerous applications for HTS trapped-field magnets where quickly eliminating the presence of the field is desirable as in a dent pulling apparatus, for example.

Another specific application for HTS trapped field magnets of the present invention is in the field of magnetic resonance imaging (MRI). MRI was first proposed by Paul Lauterbur in 1973 as a non-intrusive probe to biological samples in vitro or in vivo without bleaching or damage by ionizing radiation.

MRI now serves as one of the most effective diagnostic tools in the clinical arena, particularly for soft tissues. Its great impacts on the fields of agriculture and aquaculture have also been recently recognized and demonstrated for MRI's ability to monitor in-situ the environmental influence on the growth of plants and marine life. Unfortunately, the full potential of MRI has not yet been fully realized due to the high construction and operation of the machine. In recent years, great efforts have been made to expand the MRI probing-scale from macroscopic to microscopic with improved resolution imaging to resolve the anatomical details of accurate medical diagnosis. MRI technology essentially includes three components: the magnet system, the sensor system, and the data processing system. The present invention will remove the obstacles due to high costs mentioned above to a large extent. The HTS-trapped field magnets of this invention are very compact and can generate very strong magnetic fields. They are inexpensive to construct (since no power supply is needed and easy to charge by using a template) and to operate (since HTS-trapped field magnets are not hospital bound due to their compactness and no expensive liquid helium is needed). The additional advantage of this invention is the higher field achievable, which increases the resolution and also enables the performance of spectroscopy examination of a living object, e.g., to monitor the sodium resonance in heart examinations.

BRIEF DESCRIPTION OF THE DRAWINGS

A better understanding of the invention can be obtained when the following detailed description of the preferred embodiment is considered in conjunction with the following drawings, in which:

FIG. 3D also depicts field strength of a regular cylinder of HTS having a radius r equal to $(Z_2-Z_1)/2$;

FIG. 7A is a diagram of the magnetic field; and

DETAILED DESCRIPTION OF THE PREFERRED EMBODIMENT

The present invention provides a method for fabricating very strong HTS trapped-field magnets. Since such magnets are many times more powerful than the most powerful conventional permanent magnets, e.g. $Nd_4Fe_{12}B$ with a maximum field strength of ~0.4 T, the present invention has applications as replacement for conventional permanent magnets and in uses wherein the limitations of conventional permanent magnets made magnetic implementation impractical or impossible. Since these magnets are inexpensive to construct and to operate, they can also replace many of the electromagnets made from the conventional copper wires or low temperature superconducting wires.

The magnets of the present invention have applications that include among many others magnetic clamps, magnetic rivet guns, magnetic dent pullers, homoplanar generators, ultra-high field magnets for research, and high and ultra-high field magnets for table top magnetic resonance imaging equipment for biological and mineralogical diagnoses.

Not only do the magnets of the present invention provide much stronger magnetic fields than permanent magnets, they also have advantages of compactness without bulky power supplies and high energy efficiency over conventional electromagnets. These advantages and characteristics enable the transformation of existing machinery into more powerful, more efficient, more compact and safer machines and enable the development of new applications never before imagined due to the limitations of conventional permanent magnets.

One key factor in achieving enhanced $B_T$ in HTS trapped field magnets is to overcome the obstacle posed by flux avalanche (FA) due to thermal instabilities. The critical size is determined by the critical current density $J_c$, the brick heat capacity, and its heat conductance. E. W. Collins, "Advances in Superconductivity II" (Springer-Vertag, Berlin, 1990, p. 327) has estimated the critical size for $YBa_2Cu_3O_7$. In the directions perpendicular to the field, the critical size is approximately 2 mm at 4.2 K., and 20 mm at 20 K. Along the field direction (along the c-axis of the crystal structure), the dimension is not limited by flux avalanche.

Figure 1A:
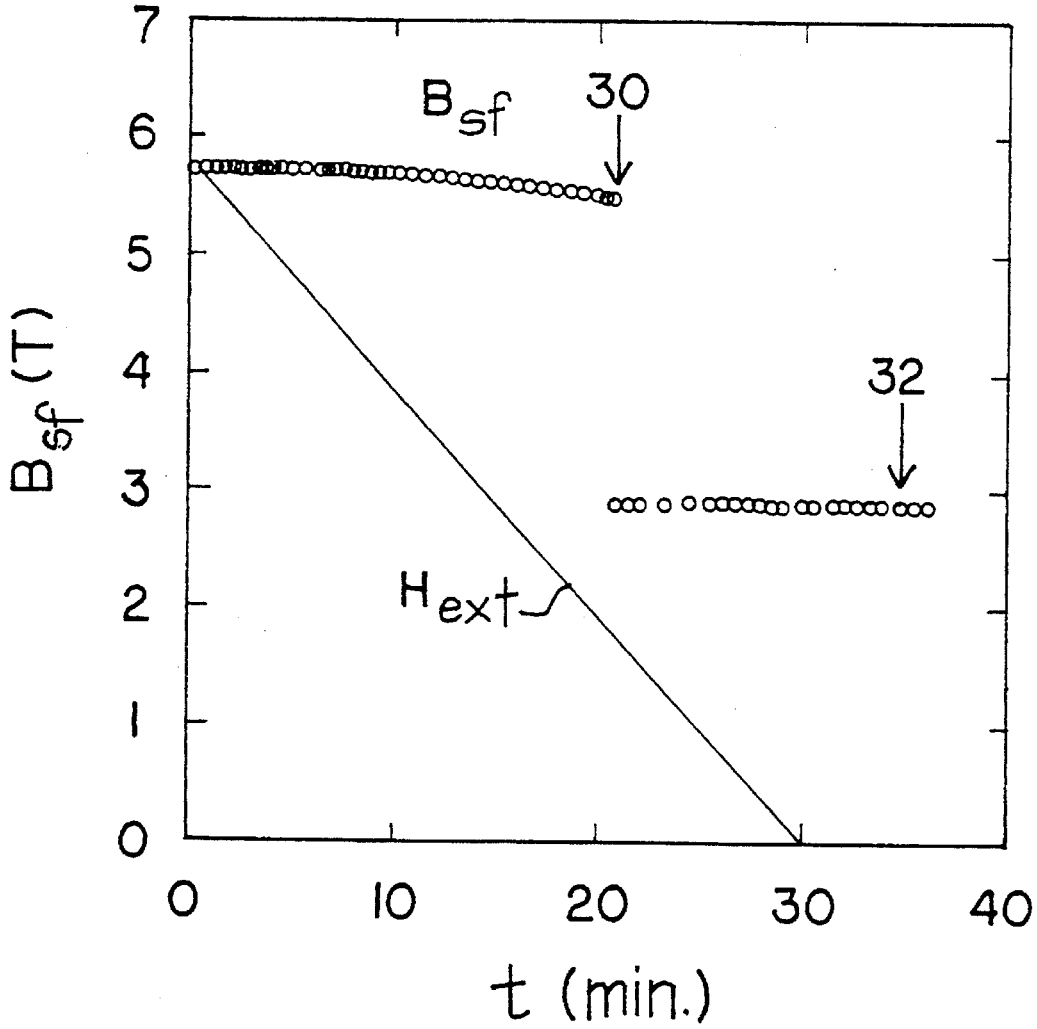
FIG. 1*a* graphically depicts the flux avalanche effect in a single-grain HTS sample (20 mm diameter by 7 mm). The surface field $B_{sf}$ of the sample is measured while the external charging field $H_{ext}$ is ramped down at a constant rate, where $B_T$ is $B_{sf}-H_{ext}$.
Figure 1B:
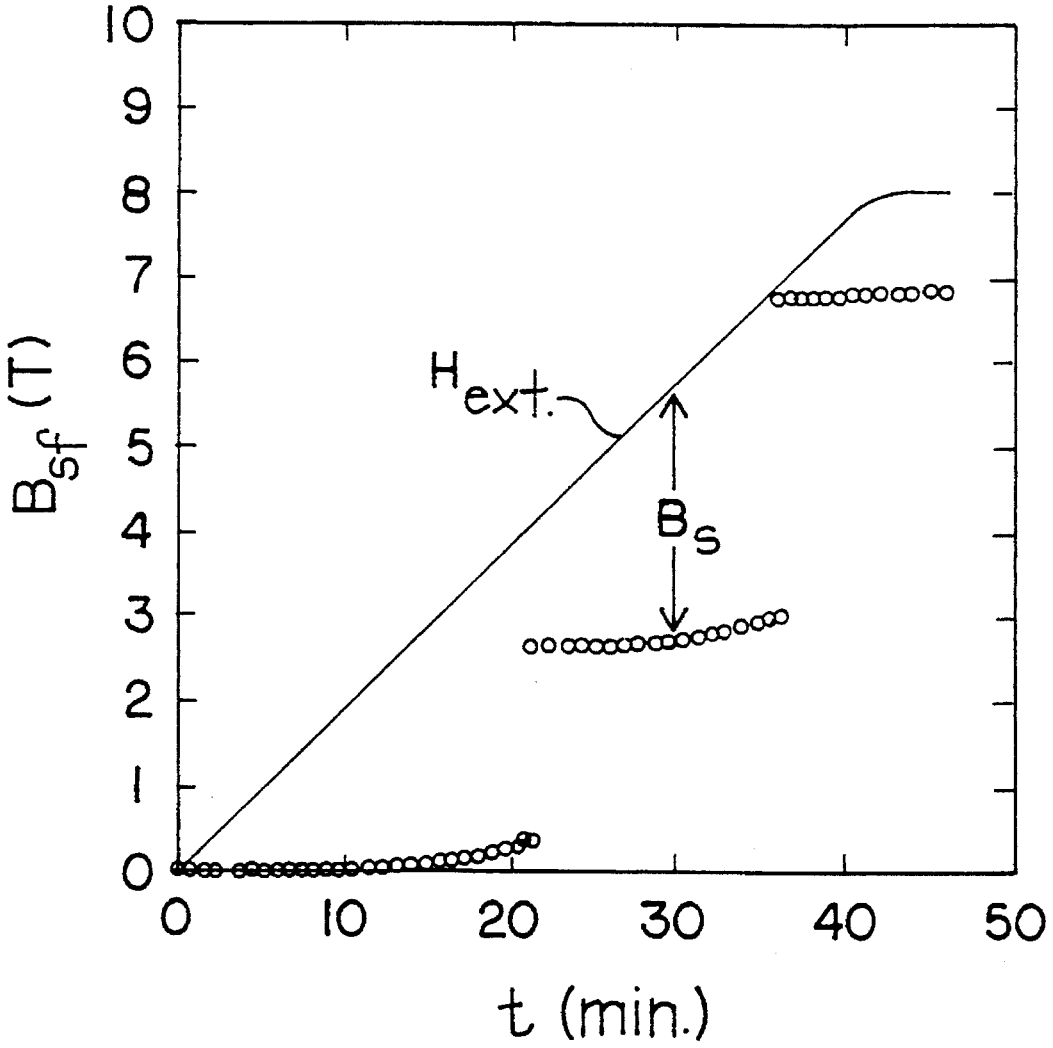
FIG. 1*b* graphically depicts the magnetic shielding effect by a single-grain HTS (20 mm diameter by 7 mm) wherein the field $B_{sf}$ is the field measured at the surface of the HTS, and the shielded field $B_s$ is $H_{ext}-B_{sf}$.

The present invention avoids these limitations by using stacks of many small, single-grain HTS bricks each of dimensions less than the critical size for flux avalanche. Referring now to FIG. 1*a*, the flux avalanche effect in a single-grain HTS sample (20 mm diameter by 7 mm) is illustrated. The surface field $B_{sf}$ of the sample is measured while the charging field $H_{ext}$ is ramped down at a constant rate where $B_T$ is $B_{sf}-H_{ext}$. In FIG. 1*b*, the magnetic-shielding effect by a single-grain HTS (20 mm diameter by 7 mm) is illustrated wherein the field $B_{sf}$ is the field measured at the surface of the HTS and the shielded field $B_s$ is $H_{ext}-B_{sf}$.

Figure 1C:
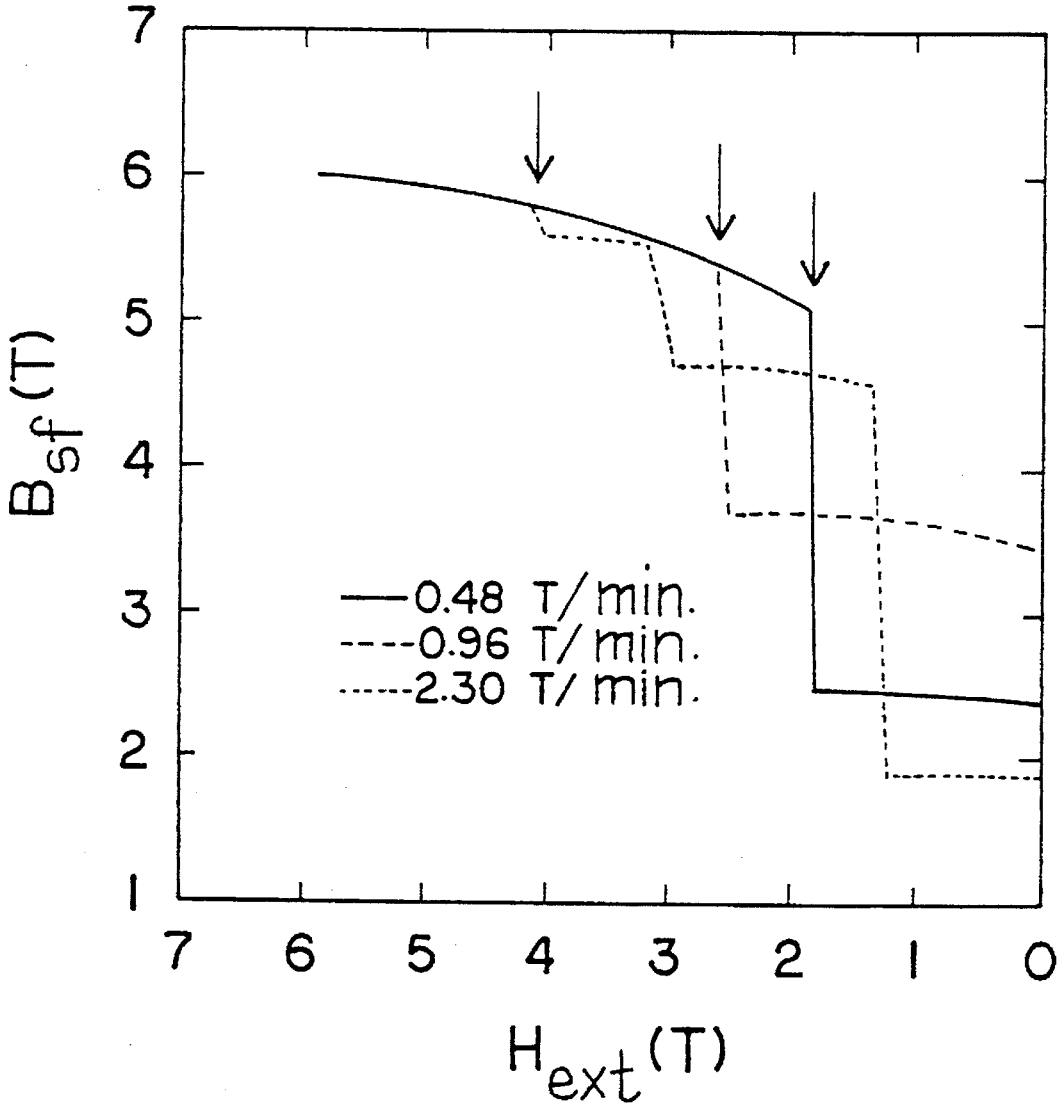
FIG. 1*c* graphically illustrates the relationship between flux avalanche (FA) and the rate at which $H_{ext}$ is ramped down.

Referring now to FIG. 1*b*, it has been shown that a single-grain HTS can shield an external magnetic-field, $H_{ext}$ from entering the HTS. The leakage field is represented by $B_{sf}$ measured at the center of the surface of the HTS. FIG. 1*b* illustrates the penetration of external field over time t in minutes as the external field $H_{ext}$ is ramped up. The shielding field is approximately $B_S=H_{ext}-H_{sf}$. FIG. 1*c* graphically illustrates the relationship between flux avalanche (FA) and the rate at which the external charging field $H_{ext}$ is ramped down.

Figure 2A:
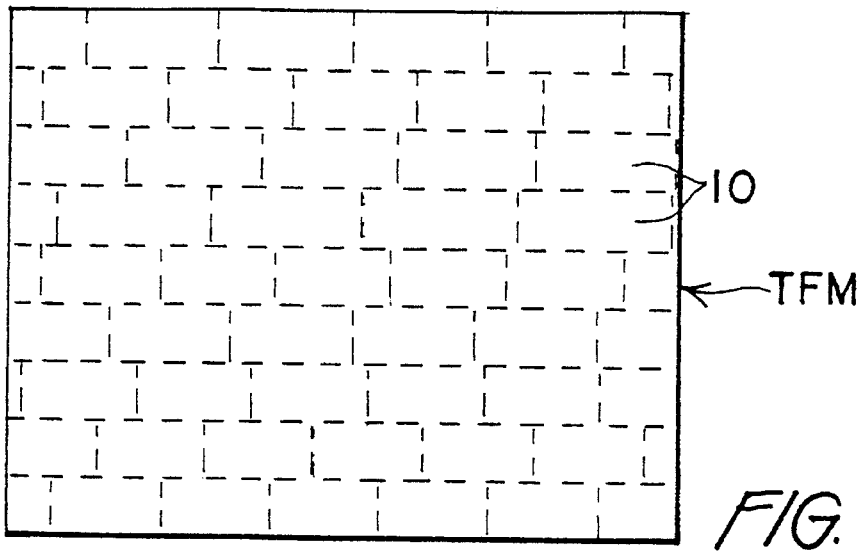
FIG. 2A is a schematic illustration of a composite trapped-field magnet (TFM) formed of a stack of single-grain HTS bricks, each having overall dimensions smaller than the critical value for flux avalanche.

Referring now to FIG. 2A, a composite trapped field magnet TFM is illustrated. TFM is formed of a plurality of individual HTS bricks 10 each of which are of generally rectangular form and of dimensions less than the critical dimensions for flux avalanche.

Note that the boundaries of individual bricks 10 are defined in FIG. 2A by dotted lines, but that the TFM is formed by adhering these bricks together to form a composite unitary body. In the preferred embodiment, bricks 10 are joined using either an epoxy such as Stycast™, soft metals such as In or other suitable cementing materials having appropriate thermal and chemical properties so that they are pliable and do not chemically interact with HTS bricks 10. In the preferred embodiment where the TFM is formed using the field-cooled mode, i.e. where the field is applied then the temperature dropped as explained below, no adhesives are necessary because the individual HTS bricks 10 are held together by their mutual magnetic interaction.

In analyzing and estimating $J_c$ of a superconductor, including those of irregular shape, Bean's model has been extensively utilized by measuring the magnetic moment M associated with $B_T$. For a superconductor of Volume V, which consists of many grains each of an effective size d, the magnetization m is related to $J_c$ by $m=M/V=J_c d/30$ (m is in $10^{-4}$ T, $J_c$ in A/cm$^2$, and d in cm), neglecting the demagnetization factor and the field dependence of $J_c$. Since the maximum $B_T$ by this superconductor at its surface is proportional to m, it was generally and incorrectly believed that the $B_T$ of a stack of HTS bricks or grains could not exceed that of a single brick.

Figure 2B:
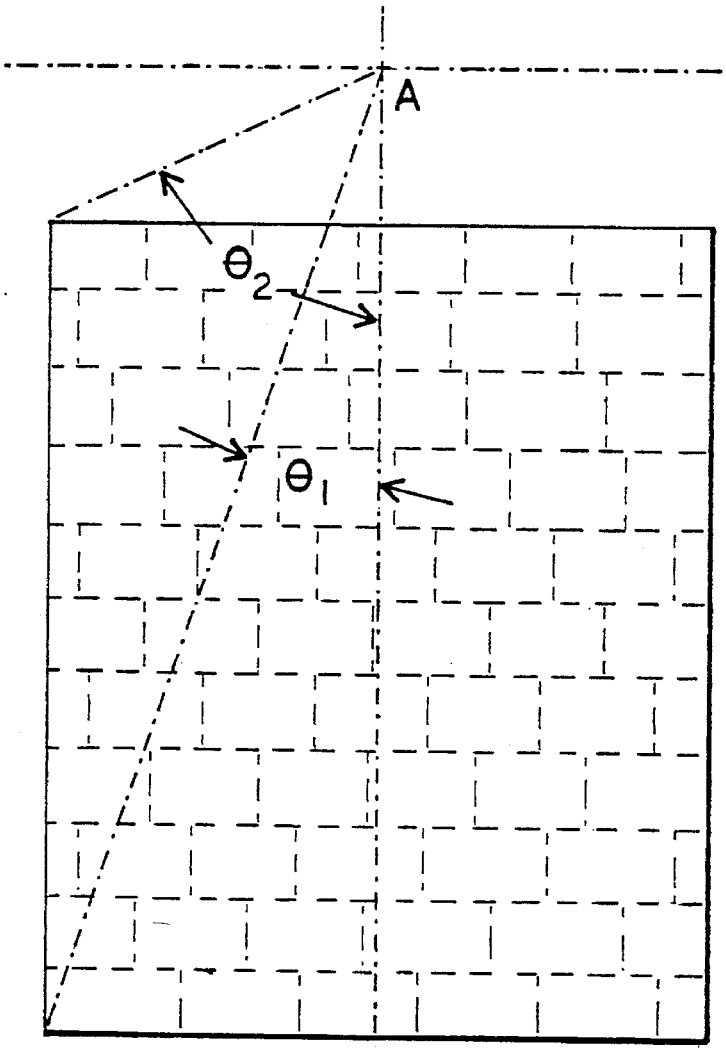
FIG. 2B is a schematic illustration depicting the position factors with respect to a cylindrical stack of HTS bricks that affect $B_T$ as measured at point A.

A careful examination has revealed that $B_T$ near a brick of finite thickness at the center of its surface is smaller than $2\pi m$. For example, in dipole approximation, the axial $B_T$ at the center of a solid HTS cylinder (FIG. 2B) is $B_T=2\pi m(\cos\theta_1-\cos\theta_2)$. $B_T$ approaches $2\pi m$ only when its length becomes infinite and $B_T$ is measured at the surface. The same approximation also applies for a stack of HTS bricks 10, each of which is considered a dipole. In other words, $B_T$ increases as more and more HTS bricks are stacked together.

Figure 2C:
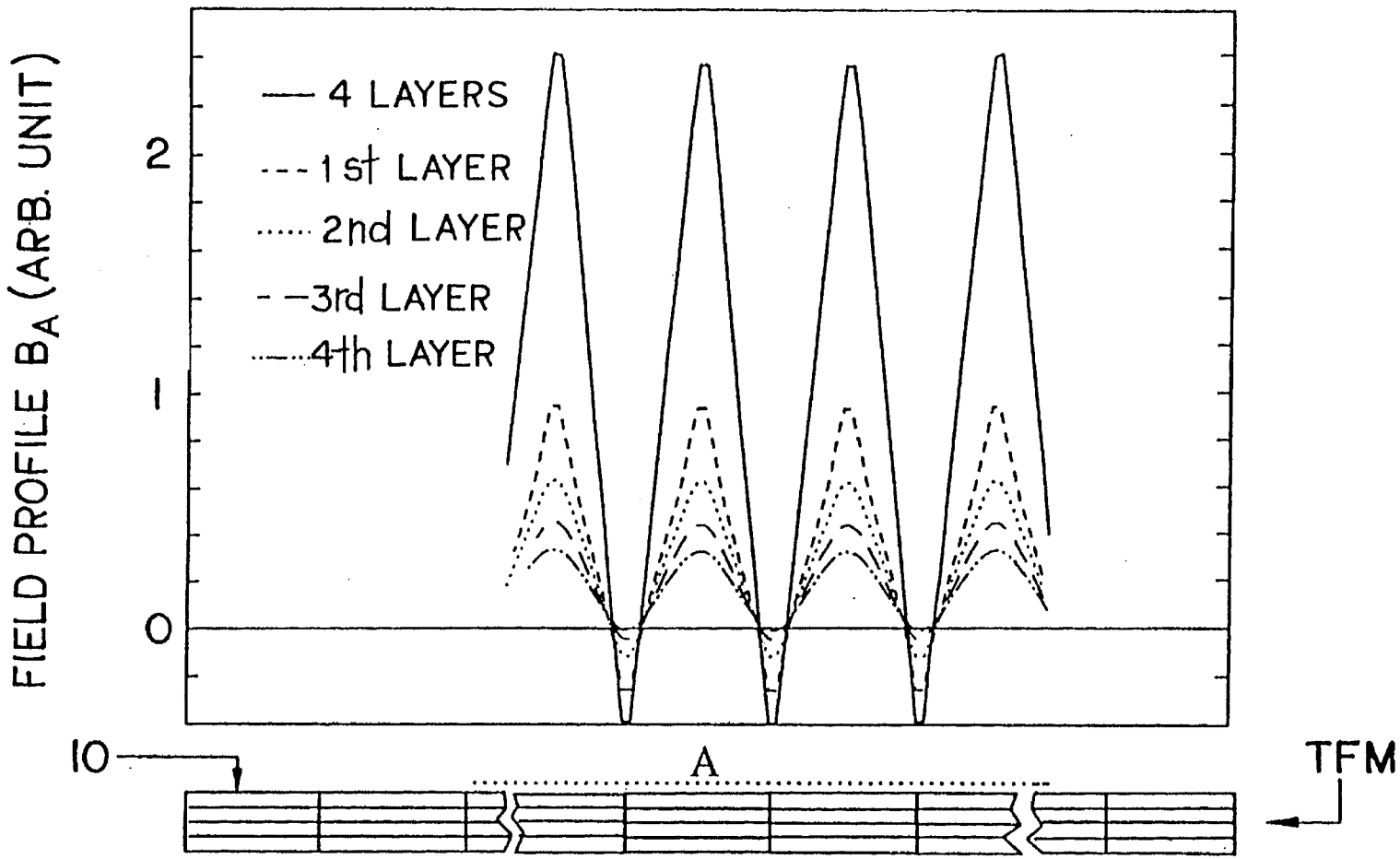
FIG. 2C is a graphic illustration of predicted field strength $B_T$ measured along line A above a stack of multiple single-grain HTS bricks using one stacking technique.
Figure 2D:
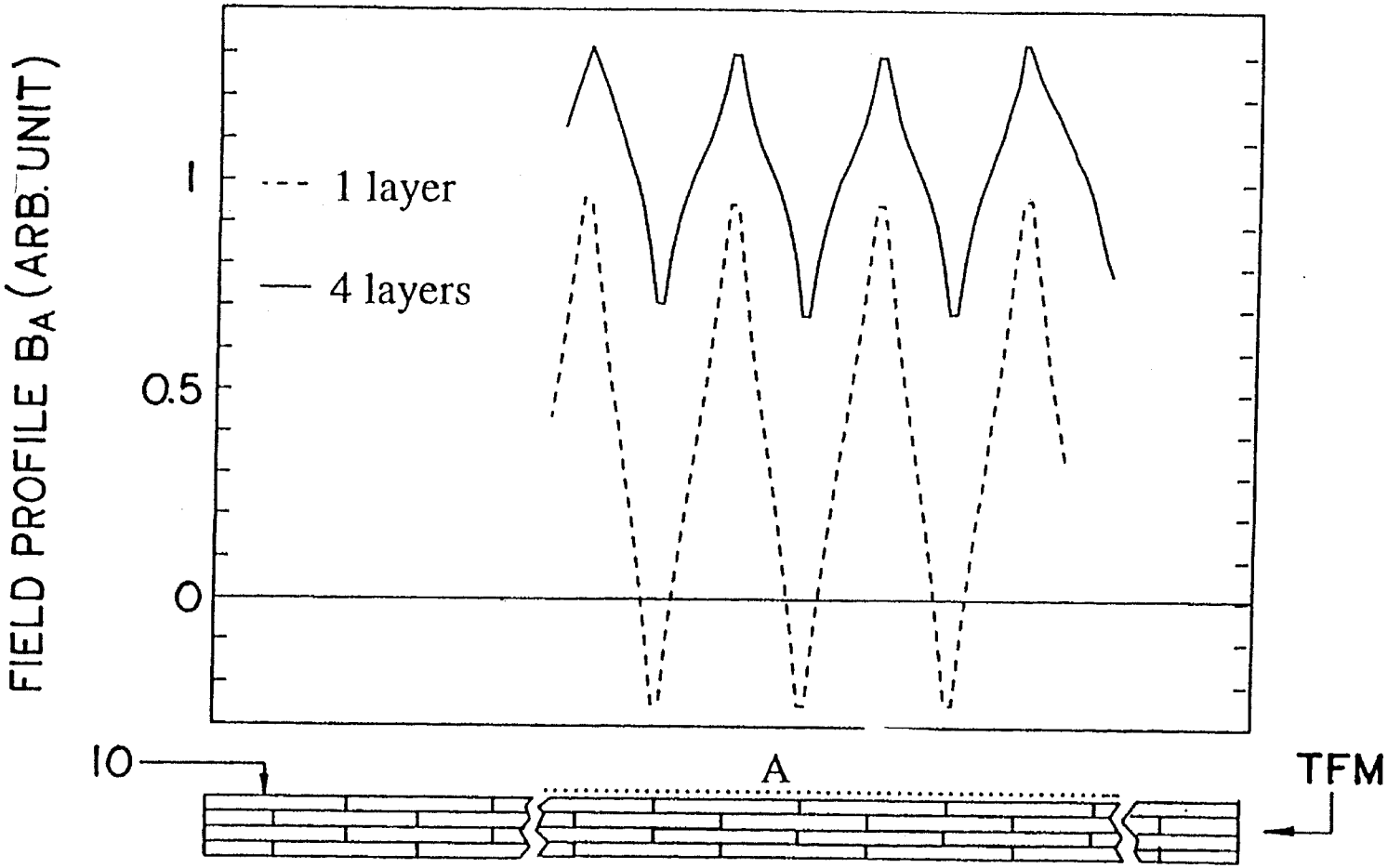
FIG. 2D is a graphical illustration of predicted field strength $B_T$ measured along line A above a stack of multiple single-grain HTS bricks using another second stacking technique.
Figure 2E:
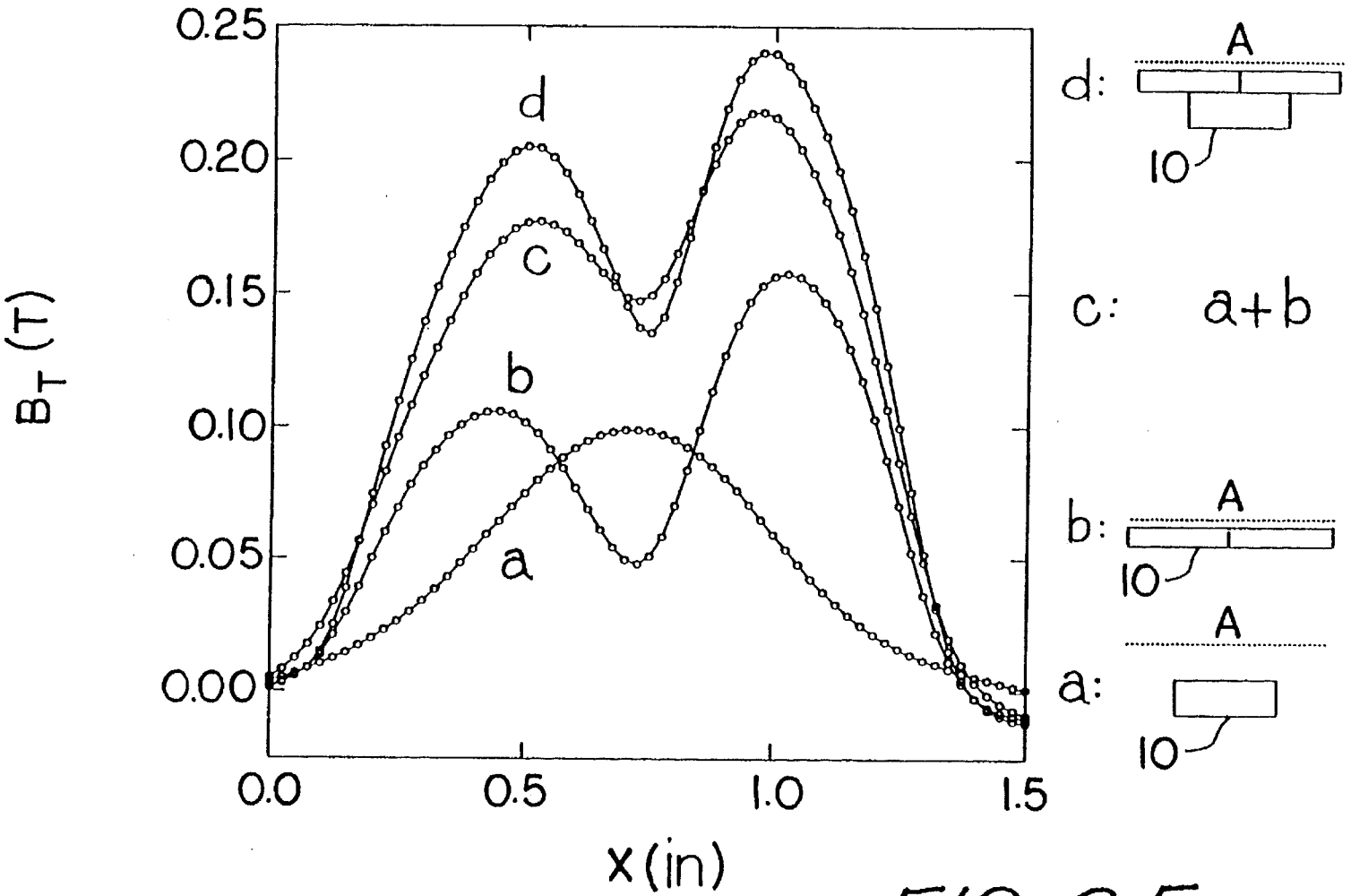
FIG. 2E is a graphical depiction of experimentally measured field strength $B_T$ along line A for several HTS brick stacking configurations.

A direct electromagnetic theory calculation shows that the $B_T$'s of individual HTS bricks are additive as shown in FIGS. 2C and 2D for two different stackings, one to achieve greater maximum $B_T$ and the other to achieve a more uniform $B_T$. This is born out by our experimental measurements shown in FIG. 2E. Note, that as depicted in FIG. 2*d*, the $B_T$ trapped by the combination of two sets of HTS bricks is even greater than the arithmetical sum of the $B_T$'s trapped by the two separate sets. In addition to the avoidance of flux avalanche, a significant advantage of using smaller HTS grains is to eliminate the problems associated with processing large, high quality, single-grain HTS samples.

Figures 3A, 3B:
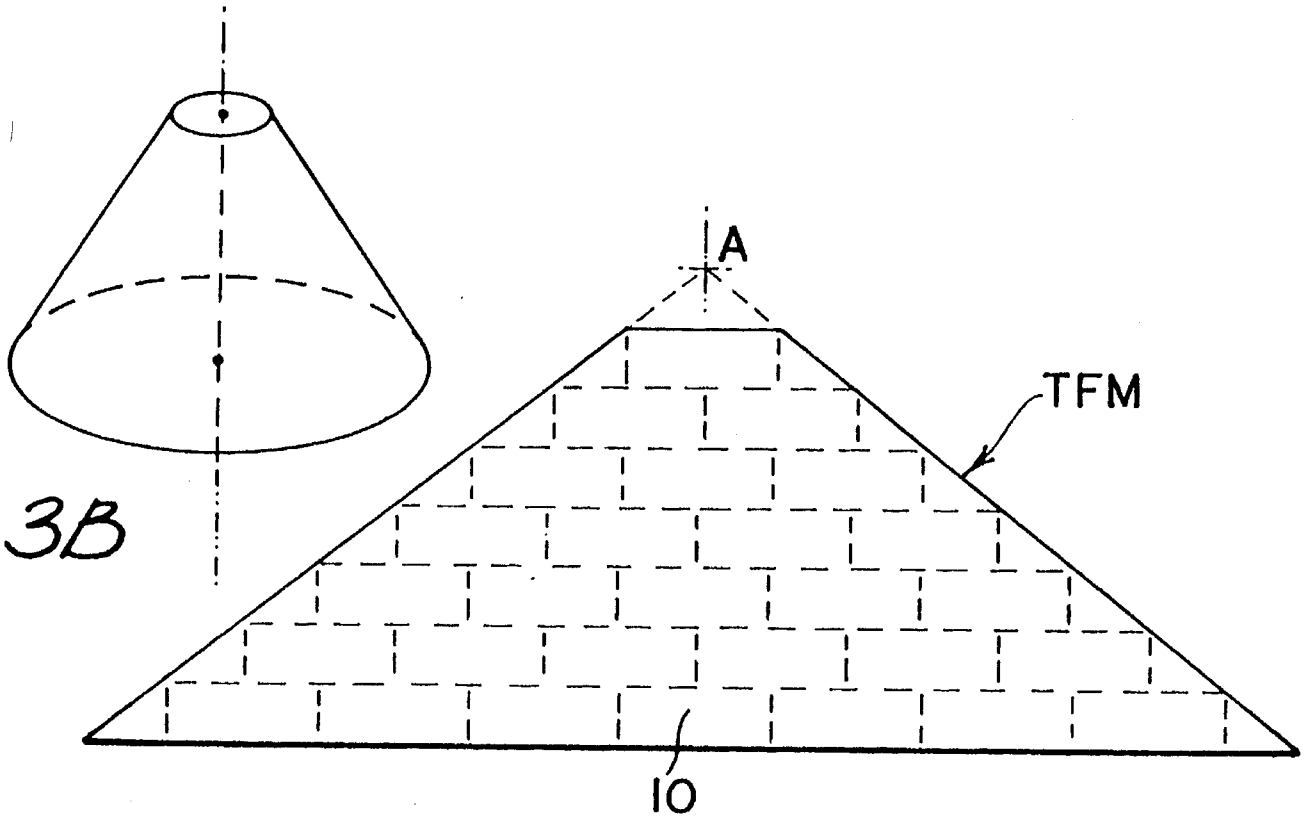
FIG. 3A is a schematic elevational view of a preferred HTS stacking configuration to enhance $B_T$, measured at point A.
FIG. 3B is an isometric view in support of FIG. 3*a;*
Figure 3C:
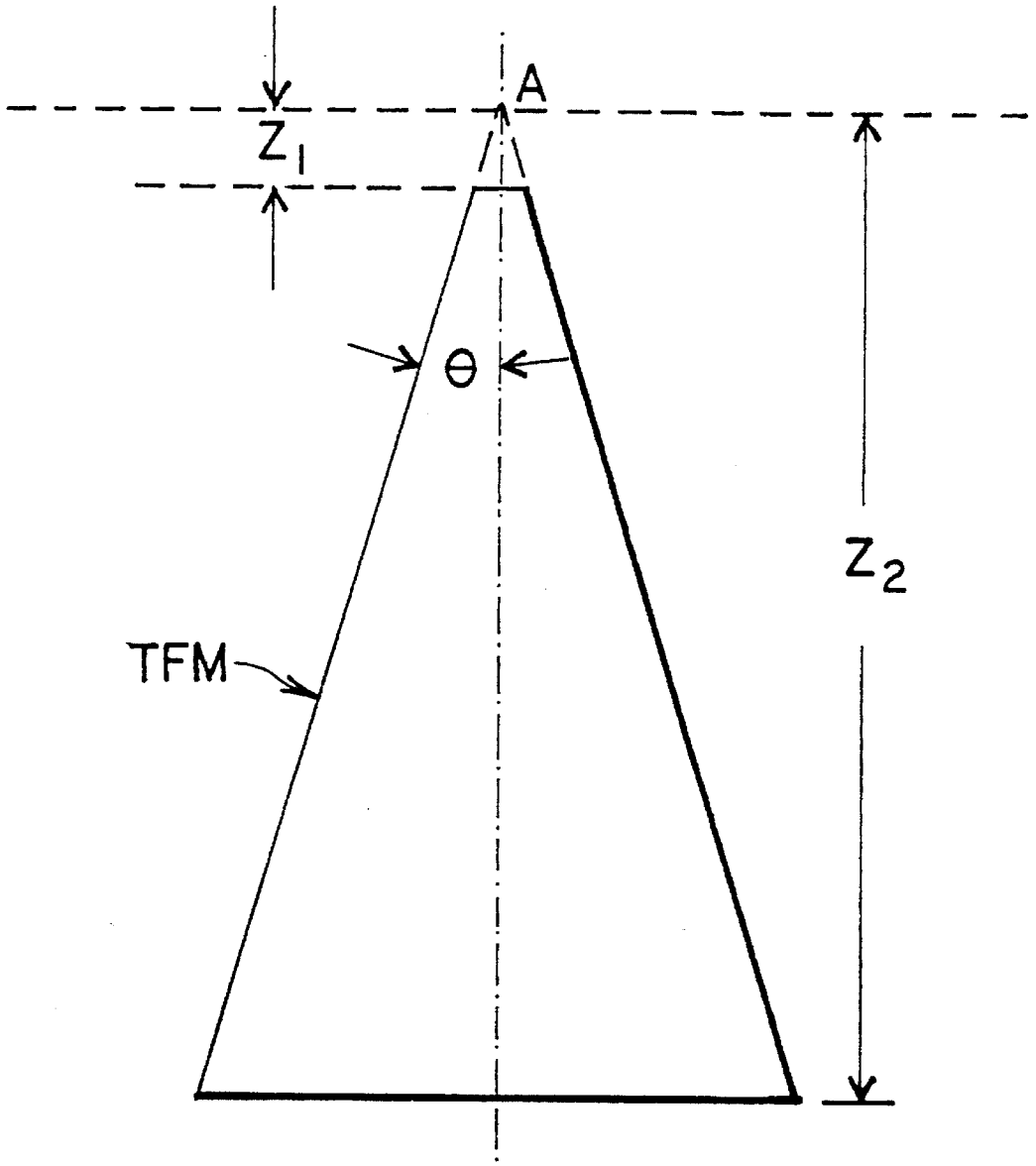
FIG. 3C is a schematic illustration of a cone-shaped stack of HTS bricks, where field strength $B_T$ is measured at point A along the axis of the cylindrical cone.
Figure 3D:
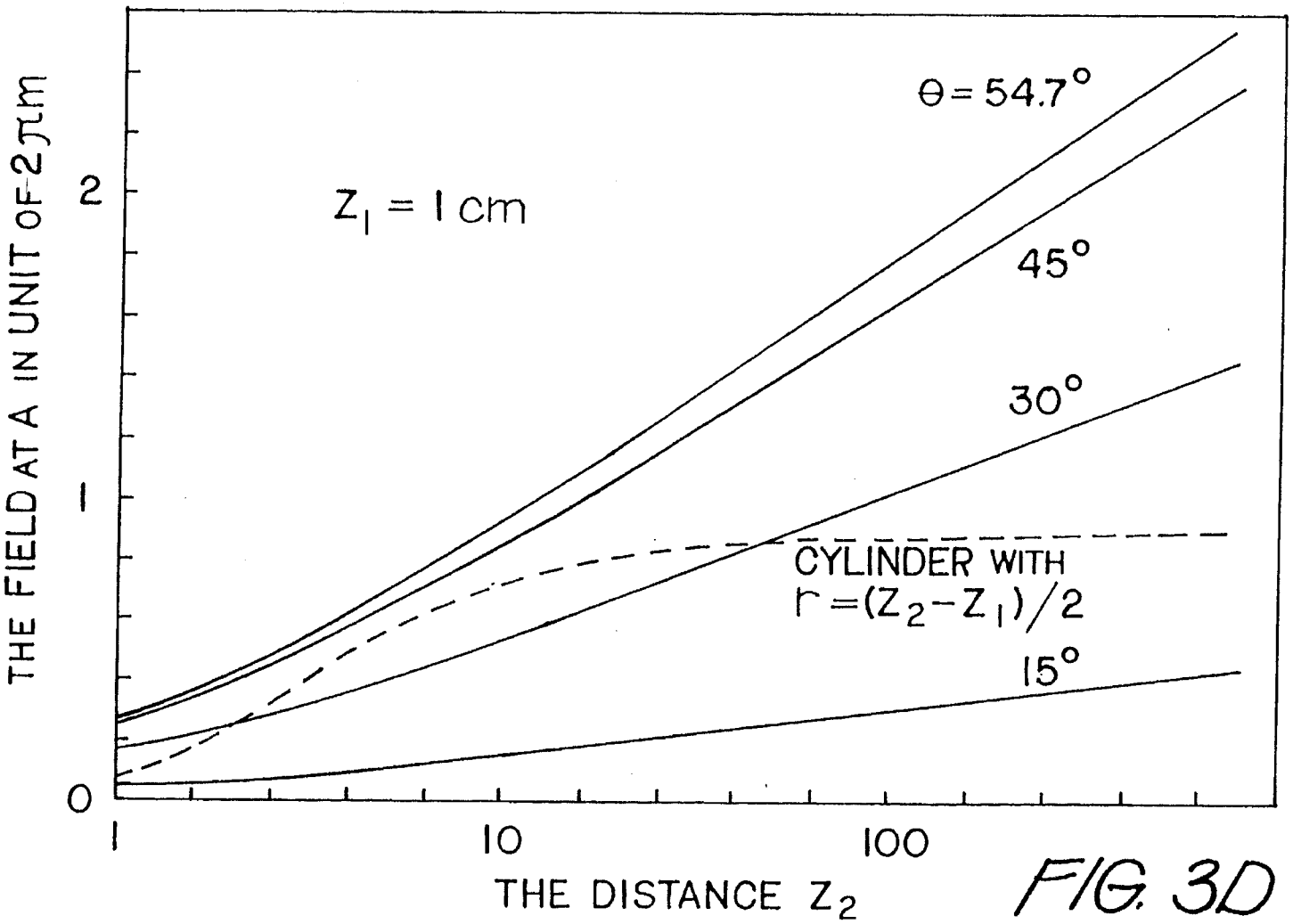
FIG. 3D is a graphical depiction of the relationship between $B_T$ measured at point A and $Z_2$ (FIG. 3C) when $Z_1$ (FIG. 3C) is fixed at one centimeter, and for various angles θ (FIG. 3C)

Referring now to FIG. 3A, a truncated cone-shaped TFM formed of a plurality of HTS bricks is illustrated. Each brick 10 is smaller than the critical dimension for flux avalanche. In the dipole approximation where the $B_T$ is underestimated at a distance comparable to or smaller than the brick size, the magnetic field at the center A above the truncated cone-shaped TFM in FIG. 3C is $B_T=2\pi m\,[\cos\theta\sin^2\theta\ln(Z_2/Z_1)]$. For the same $Z_1$, $Z_2$, $B_T$ will be maximum when the half-cone angle $\theta=54.7°$. The amplification of $B_T$ in the unit of $2\pi m$ is shown in FIG. 3D for different values of $\theta$ and $Z_2$. Comparison with a cylinder made of the same HTS grains with a length of $(Z_2-Z_1)$ and radius $r=(Z_2-Z_1)/2$ is also given in FIG. 3D. The cone-shape arrangement provides enhanced $B_T$ and also saves HTS material for the TFM.

Figures 4A, 4B, 4C:
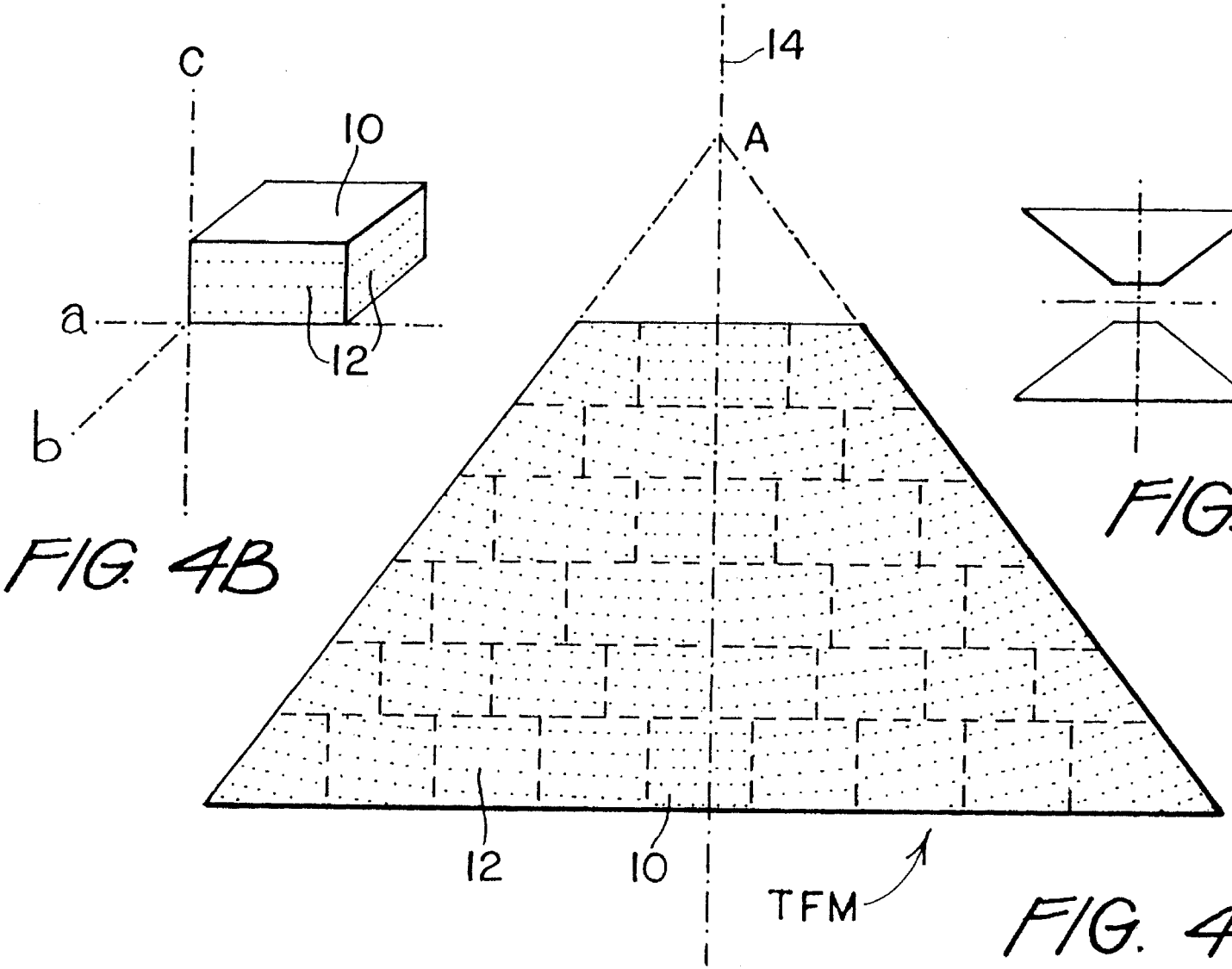
FIG. 4A schematically illustrates a stacking configuration for a truncated cone HTS stack wherein individual HTS bricks are oriented with different angular relations to the axis of the cone to enhance the magnetic field strength at point A.
FIG. 4B is an isometric view in support of FIG. 4A, where dotted lines represent A—B planes of the HTS.
FIG. 4C is a schematic diagram in support of FIG. 4A.
Figures 4D, 4E:
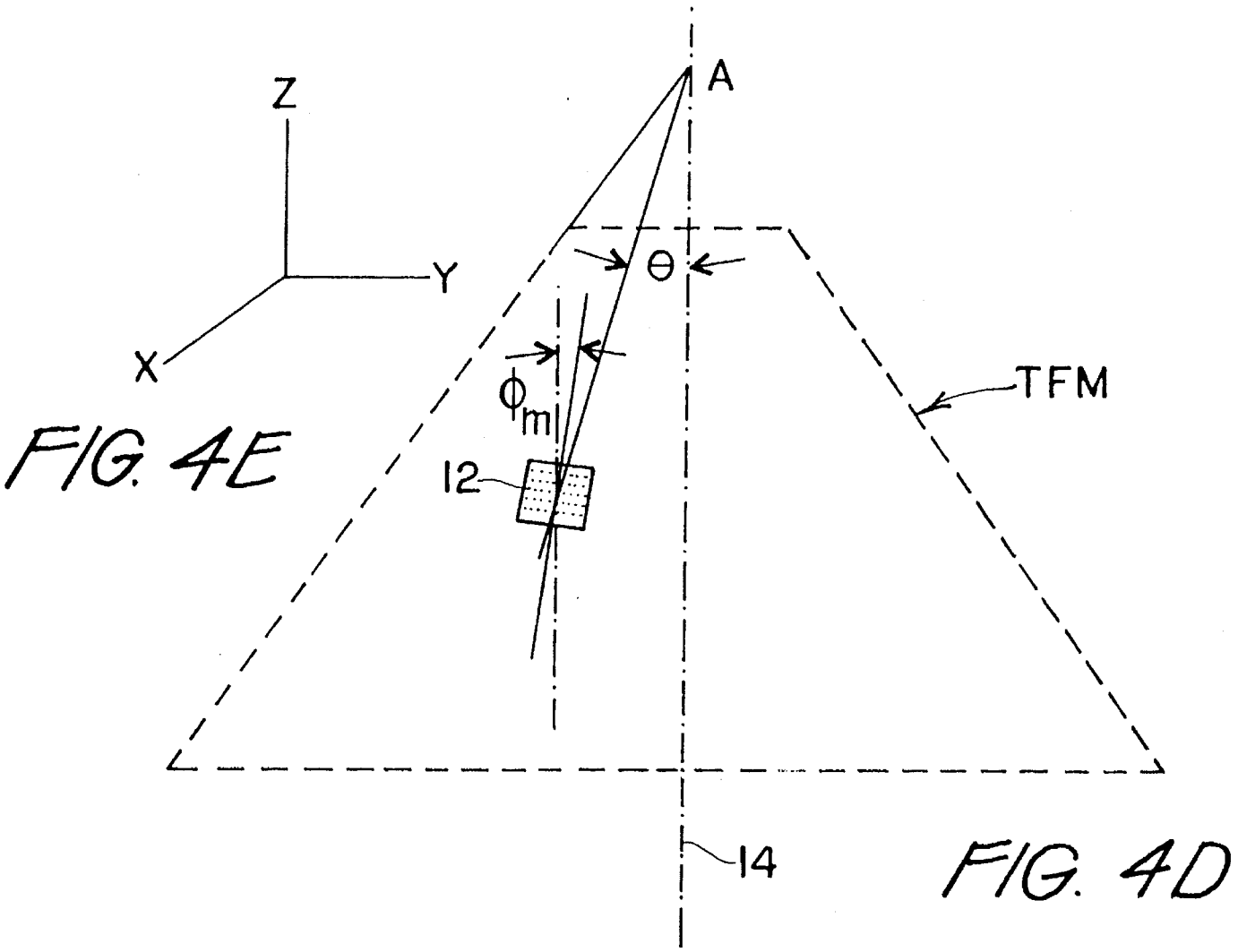
FIG. 4D depicts geometrical relationships for variables $\phi_m$ and θ with regard to the axis of the cone.
FIG. 4E is an isometric diagram in support of FIG. 4D.

Referring now to FIG. 4A, a stacking arrangement in a TFM wherein HTS bricks 10 are angularly oriented with respect to central axis 14 is illustrated. Referring to FIG. 4D, it has been shown that the magnetic field in the "Z" direction as defined in customary cartesian coordinates (inset, FIG. 4E) generated by a dipole will be maximized if the dipole (individual brick 10) is aligned at an angle $\phi_m$ with respect to the "Z" direction, where $\tan\phi_m=3\sin\theta\cos\theta/(3\cos^2\theta-1)$. For an optimal cone-shaped stack of bricks whose directions are optimally oriented, the field $B_T$ generated by such an HTS-TFM is:

$$B_T = \pi m \ln\left(\frac{z_2}{z_1}\right)\left[2+\frac{1}{\sqrt{3}}\ln(\sqrt{3}+2)-\cos\theta\sqrt{3\cos^2\theta+1}-\frac{1}{\sqrt{3}}\ln(\sqrt{3}\cos\theta+\sqrt{3\cos^2\theta+1})\right].$$

Figure 4F:
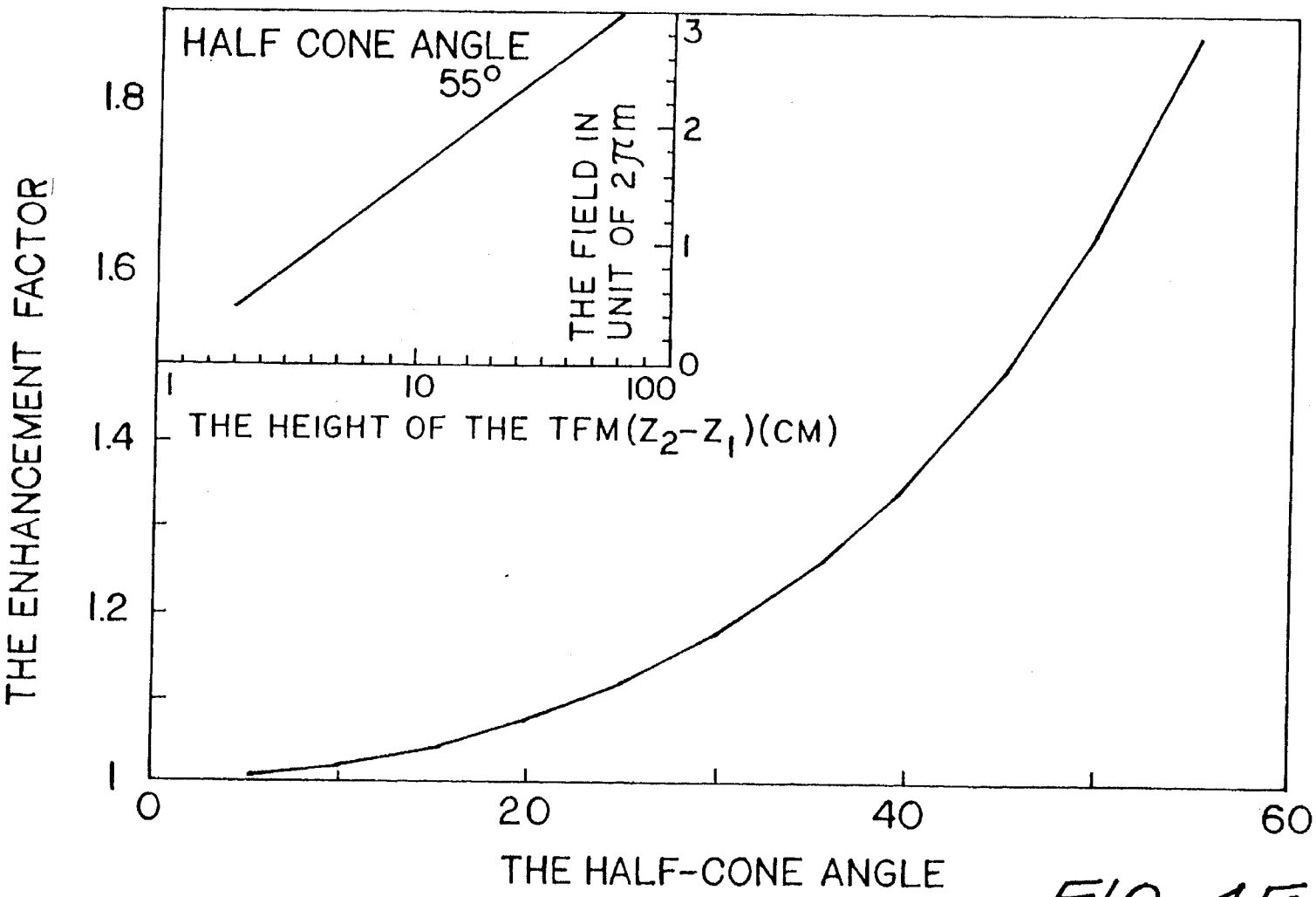
FIG. 4F depicts the relationship between the half-cone angle θ (FIG. 3C) and the field enhancement factor for an optimally oriented stack of HTS bricks.

The enhancement factor for a stack of HTS bricks 10 with optimal orientations is shown as a function of half-cone angle $\theta$ in FIG. 4F, where the insert describes the $B_T$ for such a cone HTS-TFM of various thickness with a half-cone angle of 55°. At high field strengths, the $J_c$ flows predominantly in the ab-plane 12 of an HTS (dotted lines and FIGS. 4A and 4B). This anisotropic characteristic makes possible optimal orientational stacking of small HTS bricks for HTS-TFM's (FIG. 4A). One basically can orient bricks 10 with their c-axes pointing in the prescribed direction $\phi_m$ (as calculated above) and then energize the TFM through a field-cooled or zero-field cooled mode in a uniform field. For these purposes, the $\phi_m$ orientation is determined with regard to the c-axis running through the center of the brick 10.

While $\phi_m$ is more precisely determined if the brick size is small, the advantages of making the brick size as large as possible without incurring flux avalanche outweigh any loss of precision associated with $\phi_m$. A field-cooled mode is one where the HTS is cooled below critical temperature in the presence of a magnetic field. A zero-field mode is one where the HTS is cooled to below critical temperature before the field is energized.

Figure 5:
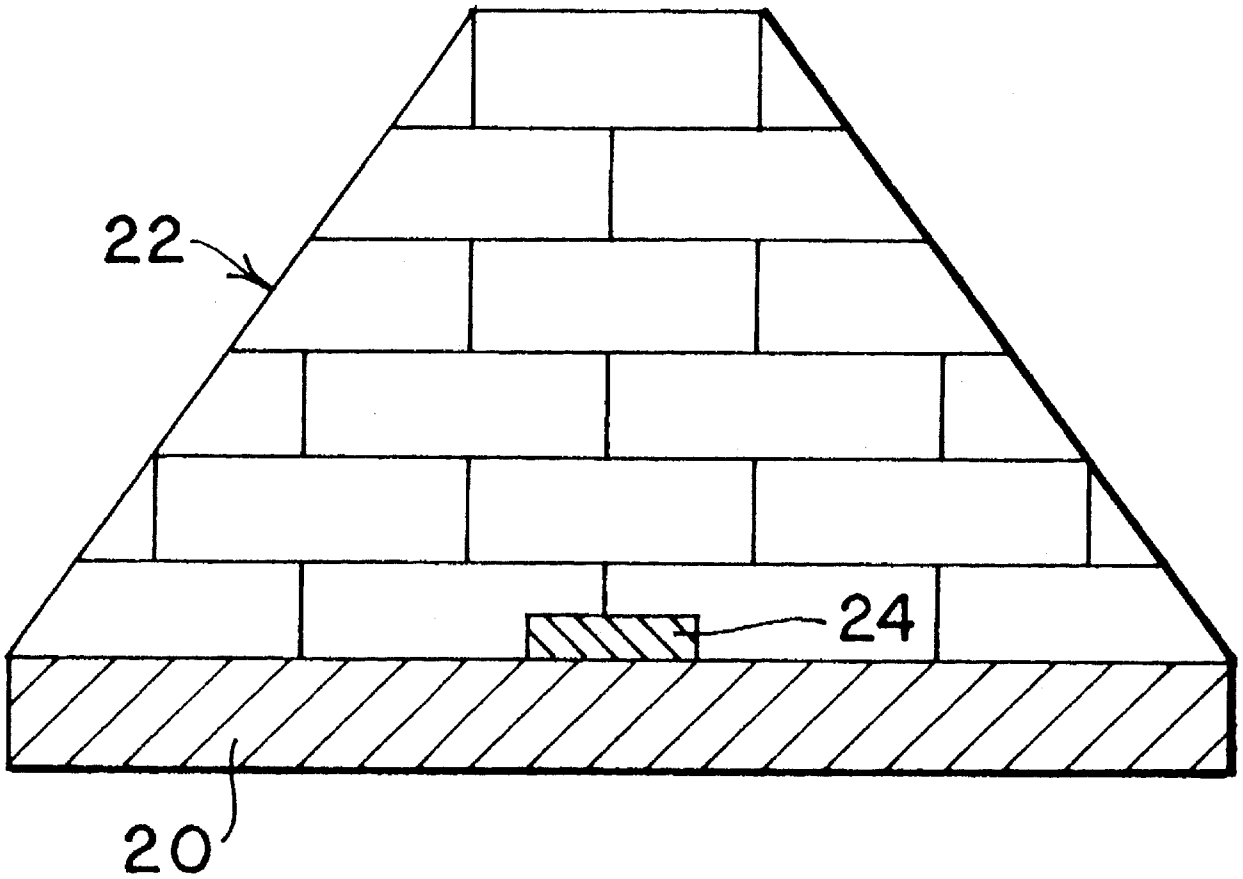
FIG. 5 is a schematic illustration of an HTS trapped field magnet wherein flux avalanche (FA) is controlled by attaching an electromagnetic, acoustic and/or thermal transducer to the HTS and wherein the HTS is maintained in a metastable state for FA instabilities by bonding it to a permanent magnet.

Referring now to FIG. 5, an application of the invention is schematically illustrated wherein the flux avalanche characteristic of an HTS-TFM is controlled so that the strong field can be turned off or quenched rapidly for various applications. For some applications, such as dent-pullers, it is required to quench or rapidly reduce the trapped field B. Stated another way, one needs to produce very large |dB/dt|. Without flux avalanche, the large thermal capacitance of an HTS-TFM makes it practically impossible to quench the $B_T$ quickly using an external heat source and the large upper critical-field of an HTS renders it extremely difficult to quench quickly using an external magnetic field.

Based upon experimental observation of the flux avalanche effect illustrated in FIG. 1*a* it was discovered that the flux avalanche effect could be controlled and used to produce a controlled, rapid quenching of $B_T$ in the TFM.

In one embodiment of this technique, a permanent magnet 20 (FIG. 5) formed of material such as $Nd_4F_{12}B$ is attached to the base of an HTS-TFM 22 to provide an ambient field to maintain the TFM 22 in its metastable state near the flux avalanche condition (FIG. 1*a*, arrow 30) after the energizing field ($H_{ext}$) is removed. A small electromagnetic, thermal or acoustic signal generated by transducer 24 attached to TFM 22 is used to trigger the desired flux-avalanche effect. Preferably, transducer 24 is located symmetrically near the base or center of TFM 22. Alternatively, the TFM can be maintained at a secondary metastable state (arrow 32, FIG. 1*a*) without the use of a permanent magnet. In this embodiment the energy provided by transducer 24 will induce the desired flux avalanche.

Since the $H_{ext}$ at which the flux avalanche or thermal instabilities occur depends on the size of the TFM, the rate of removal of $H_{ext}$ (see FIG. 1*c*), and the temperature of the TFM, to energize a HTS-TFM for such applications one must choose the proper conditions to suit particular applications. Generally speaking, at a fixed temperature, the larger the HTS element or brick, and the larger $B_T$, the easier it is to induce flux avalanche, and the faster the $H_{ext}$ is removed, the quicker the flux avalanche will occur (i.e., at higher $H_{ext}$); on the other hand, without changing $dH_{ext}/dt$ or the size of the HTS brick, the lower the temperature to energize the TFM the easier it is to induce flux avalanche.

Figure 6A:
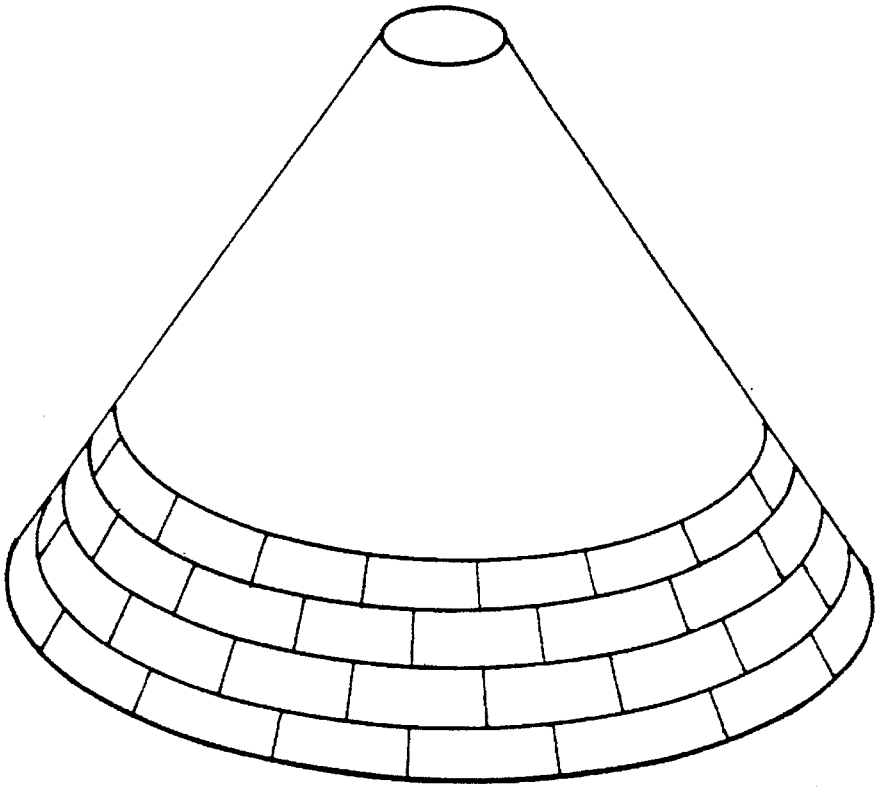
FIGS. 6*a* and 6*b* schematically illustrate alternative conical and pyramid-shaped embodiments.
Figure 6B:
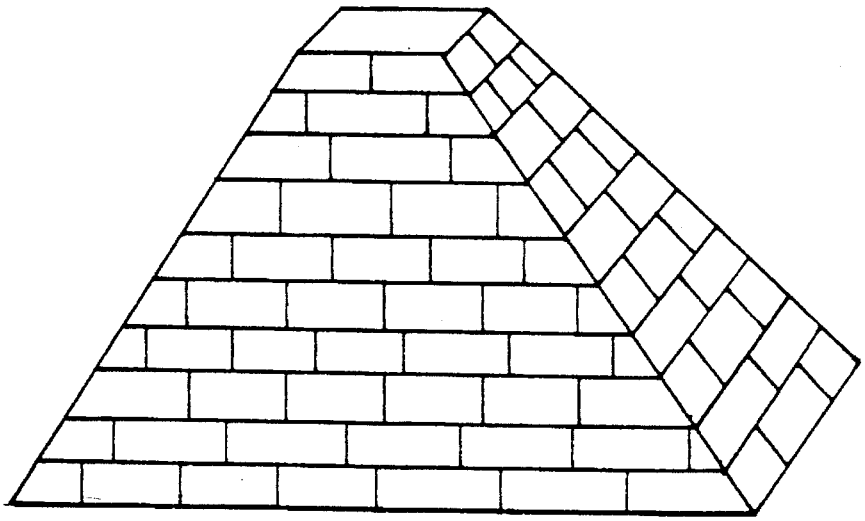

It should be noted that while the preferred embodiment of the HTS-TFM is in the form of a truncated, regular, cylindrical cone (FIG. 6*a*), the advantages of the present invention can also be realized by forming an HTS-TFM of individual bricks in other generally conical shapes. One such form is illustrated in FIG. 6*b*, wherein the HTS-TFM is generally in the shape of a truncated rectangular pyramid.

Another specific application for the HTS-TFM of the present invention is to enable the magnet system for magnetic resonance imaging (MRI). Because advanced MRI systems demand a high degree of resolution, the systems used to provide the magnetic field must produce both an intense and substantially homogeneous field. When HTS-TFM's are used, the variation of the micro-structure of the HTS material can cause field strength variation in the nature of spikes when measured close to the surface of the HTS.

Figure 7A:
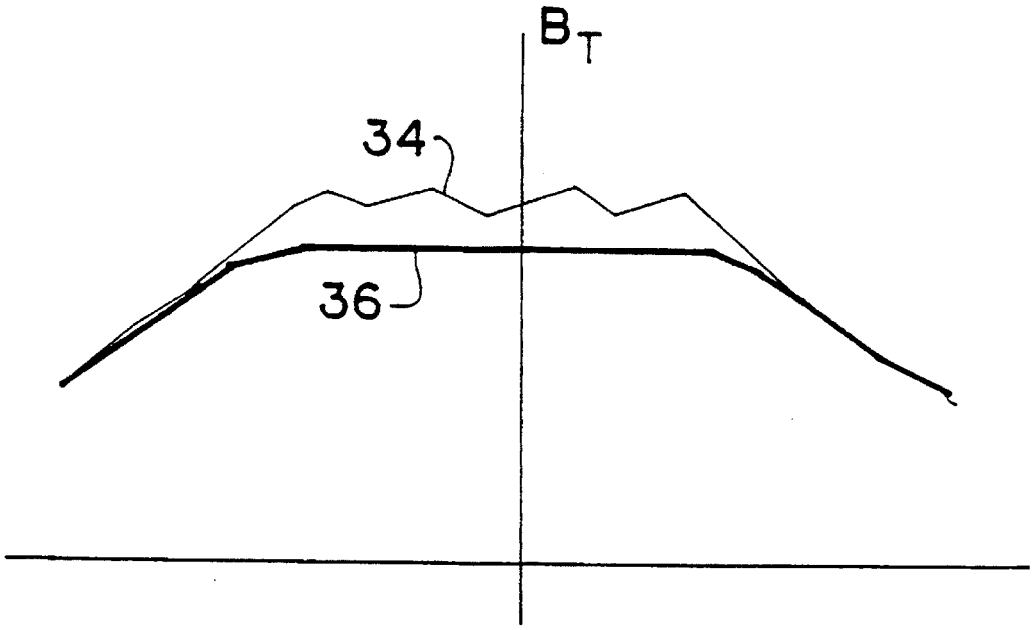
FIG. 7*a* depicts the substantially uniform surface magnetic flux density profile of the HTS-TFM structure of FIG. 3 when field cooled.
Figure 7B:
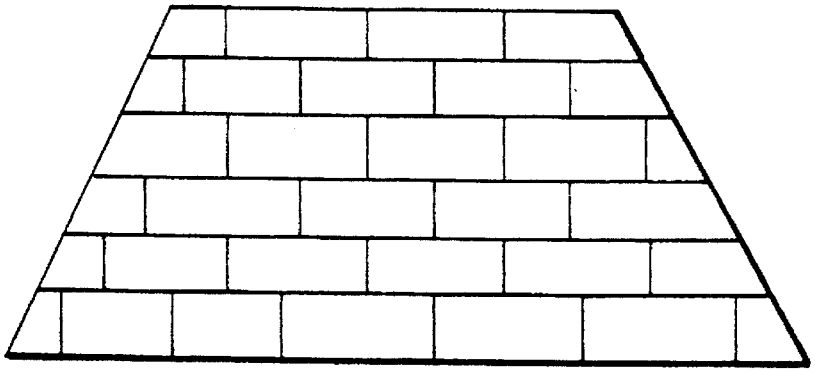
FIG. 7B schematically illustrates a partial view of a pyramid-shaped embodiment.

In the present invention, the HTS-TFM comprised of the individual HTS bricks provides a relatively intense field. Homogeneity is provided by adhering or otherwise affixing to the surface of the HTS-TFM a thin layer of soft metals or mu-metal such as Indium. This metallic layer disperses and makes more uniform the magnetic field measured just above the surface. In an alternative approach, a very uniform trapped field field 36 can be achieved by charging an HTS-TFM through the field-cool mode provided the charging field is smaller than the maximum trough field 34 when the HTS-TFM is fully charged. FIGS. 7A and 7B depicts the substantially uniform surface magnetic flux density profile in a HTS-TFM structure when field cooled. The flux density profile labelled as "trough field" illustrates that the surface flux density is not homogeneous when the HTS-TFM is maximally charged. Note that for a resulting homogeneous field, the charging field must be less than the minimum surface flux density of the structure when fully charged.

The foregoing disclosure and description of the invention are illustrative and explanatory and are not intended to impose limitations on the utility in other diverse applications for HTS trapped field magnets made in accordance with the present invention.

We claim:

1. A high temperature superconductor trapped field magnet formed of a plurality of single-grain type II high temperature superconducting elements, wherein each of said elements is of dimension less than that which produces flux avalanche when subjected to an external magnetic field sufficient to induce a trapped magnetic field in said trapped field magnet;

wherein said elements are arranged to form a composite structure in the geometric shape of a regular truncated cone;

wherein said cone is defined by a circular base and conical sides slopping at a uniform angle relative to and meeting said base, said sides terminating at a circular upper surface, said upper surface being substantially parallel to said base; and wherein the half-cone angle defined between the central axis of the cone passing through the center of said upper surface and said base and said conical sides is approximately 55°.

2. A high temperature superconductor trapped field magnet formed of a plurality of single-grain type II high temperature superconducting elements, wherein each of said elements is of dimension less than that which produces flux avalanche when subjected to an external magnetic field sufficient to induce a trapped magnetic field in said trapped field magnet;

wherein said elements are arranged to form a composite structure in the geometric shape of a regular truncated cone;

wherein said cone is defined by a circular base and conical sides slopping at a uniform angle relative to and meeting said base, said sides terminating at a circular upper surface, said upper surface being substantially parallel to said base;

wherein the half-cone angle defined between the central axis of the cone passing through the center of said upper surface and said base and said conical sides is within the range from about 30° to about 60°; and wherein said elements are individually oriented so that the angle $\phi_m$ formed between a first line parallel to the c-axis of the HTS crystal of said element and a second line, parallel to the central axis of said cone, said first and second line intersecting at the center of said element, is defined by the following relationship:

$$\tan\phi_m = 3\sin\theta\cos\theta/(3\cos^2\theta - 1)$$

where θ represents the half-cone angle to the individual element.

3. The trapped field magnet of claim 2, wherein the half-cone angle is approximately 55°.

4. A high temperature superconductor trapped field magnet formed of a plurality of single-grain type II high temperature superconducting elements, wherein each of said elements is of dimension less than that which produces flux avalanche when subjected to an external magnetic field sufficient to induce a trapped magnetic field in said trapped field magnet;

wherein said elements are arranged to form a composite structure in the geometric shape of a regular truncated cone;

wherein said cone is defined by a circular base and conical sides slopping at a uniform angle relative to and meeting said base, said sides terminating at a circular upper surface, said upper surface being substantially parallel to said base;

wherein the half-cone angle defined between the central axis of the cone passing through the center of said upper surface and said base and said conical sides is within the range from about 30° to about 60°; and wherein each of said elements is comprised of a plurality of substantially rectangular bricks of high temperature superconductive sub-elements arranged in one or more parallel rows.

5. The trapped field magnet of claim 4, wherein said half cone angle is approximately 55°.

6. A high temperature superconductor trapped field magnet comprised of a plurality of non-irradiated single-grain type II high temperature superconducting elements, wherein each of said elements is selectively dimensioned to maximize element flux density while avoiding flux avalanche when subjected to an external magnetic field sufficient to induce a trapped magnetic field in said trapped field magnet;

wherein said elements are arranged to form a composite structure in the geometric shape of a regular truncated cone;

wherein said cone is defined by a circular base and conical sides sloping at a uniform angle relative to and meeting said base, said sides terminating at a circular upper surface, said upper surface being substantially parallel to said base;

wherein the half-cone angle defined between the central axis of the cone and said conical sides is within the range from about 30° to about 60°; and wherein said elements are individually oriented so that the angle $\phi_m$ formed between a first line parallel to the c-axis of the HTS crystal of said element and a second line, parallel to the central axis of said cone, said first and second line intersecting at the center of said element, is defined by the following relationship:

$$\tan\phi_m = 3\sin\theta\cos\theta/(3\cos^2\theta - 1)$$

where θ represents the half-cone angle to the individual element.

7. The trapped field magnet of claim 6, wherein the half-cone angle is approximately 55°.

8. A high temperature superconductor trapped field magnet formed of a plurality of non-irradiated single-grain type II high temperature superconducting elements selectively dimensioned to maximize element flux density while avoiding flux avalanche when subjected to an external magnetic field sufficient to induce a trapped magnetic field in said trapped field magnet;

said elements being arranged to form a composite structure in the geometric shape of a regular truncated cone;

said cone being defined by a circular base and conical sides sloping at a uniform angle relative to and meeting said base;

said sides terminating at a circular upper surface, said upper surface being substantially parallel to said base, and wherein the half-cone angle defined between the central axis of the cone and said conical sides is within the range from about 30° to about 60°; and wherein said elements are individually oriented so that the angle $\phi_m$ formed between a first line parallel to the c-axis of the HTS crystal of said element and a second line, parallel to the central axis of said cone, said first and second line intersecting at the center of said element, is defined by the following relationship:

$$\tan\phi_m = 3\sin\theta\cos\theta/(3\cos^2\theta - 1)$$

where θ represents the half-cone angle to the individual element.

* * * * *